US007695095B2

(12) United States Patent
Shindo

(10) Patent No.: US 7,695,095 B2
(45) Date of Patent: Apr. 13, 2010

(54) IMAGE RECORDING APPARATUS

(75) Inventor: Tatsuya Shindo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 360 days.

(21) Appl. No.: 11/533,500

(22) Filed: Sep. 20, 2006

(65) Prior Publication Data

US 2007/0070114 A1 Mar. 29, 2007

(30) Foreign Application Priority Data

Sep. 27, 2005 (JP) ..... 2005-279411

(51) Int. Cl.
*B41J 2/165* (2006.01)

(52) U.S. Cl. ..... 347/29; 347/33

(58) Field of Classification Search ..... None
See application file for complete search history.

(56) References Cited

U.S. PATENT DOCUMENTS

| | | | | |
|---|---|---|---|---|
| 4,638,336 | A * | 1/1987 | Hofmann | 347/29 |
| 5,808,635 | A * | 9/1998 | Kneezel et al. | 347/41 |
| 6,309,044 | B1 * | 10/2001 | Gaarder | 347/32 |
| 6,729,717 | B2 | 5/2004 | Ito et al. | |
| 2004/0165028 | A1 | 8/2004 | Ito et al. | |
| 2005/0046666 | A1 * | 3/2005 | Horio et al. | 347/31 |
| 2005/0088494 | A1 | 4/2005 | Shimizu et al. | |
| 2005/0206691 | A1 | 9/2005 | Takata et al. | |
| 2006/0001715 | A1 | 1/2006 | Umeda et al. | |

FOREIGN PATENT DOCUMENTS

| | | |
|---|---|---|
| JP | 2001219560 | 8/2001 |
| JP | 200267312 | 3/2002 |
| JP | 2004255861 | 9/2004 |
| JP | 2005145051 | 6/2005 |
| JP | 2005262723 | 9/2005 |

* cited by examiner

*Primary Examiner*—Stephen D Meier
*Assistant Examiner*—Alexander C Witkowski
(74) *Attorney, Agent, or Firm*—Baker Botts L.L.P.

(57) ABSTRACT

An image recording apparatus including: an ink-jet head having a plurality of nozzles which are open in a surface thereof so as to provide a nozzle opening surface and through which ink is ejected, the plurality of nozzles being divided into a plurality of nozzle groups: and a plurality of caps which are provided in correspondence with the plurality of nozzle groups, each of which is formed of an elastic material, each of which has a peripheral portion that comes into close contact with the nozzle opening surface at an end thereof, and which are capable of covering the nozzle opening surface such that the peripheral portion of each of the plurality of caps surrounds nozzles which constitute a part of the plurality of nozzles and which belong to a corresponding one of the plurality of nozzle groups, wherein a first cap among the plurality of the caps has a hardness higher than that of a second cap which is different from the first cap.

25 Claims, 8 Drawing Sheets

$$P = \frac{4\,\sigma\cos\theta}{d}$$

IMAGE RECORDING APPARATUS

This application is based on Japanese Patent Application No. 2005-279411 filed on Sep. 27, 2005, the contents of which are incorporated hereinto by reference.

BACKGROUND OF THE INVENTION

1. Field of the Invention

The present invention relates to an image recording apparatus which includes an ink-jet head and a cap that covers a nozzle opening surface of the ink-jet head.

2. Discussion of Related Art

As an image recording apparatus such as an ink-jet printer which includes an ink-jet head that performs recording by ejecting ink to a recording medium, there is known one equipped with a purge device for discharging air-bubbles, poor-quality ink and the like accumulated in the ink-jet head, thereby restoring ink ejecting performance of the ink-jet head. For instance an image recording apparatus disclosed in US Patent Application Publication No. 2006/0001715 A1 (corresponding to JP-A-2004-255861) is arranged such that a suction cap connected to a suction pump covers a nozzle opening surface and is operated to suck ink from nozzles at a prescribed timing during operation of the apparatus, for thereby maintaining or restoring the ink-ejection performance.

In general, the cap is formed of a rubber-like elastic material (rubber or the like) and includes a base portion which is located apart from the nozzle opening surface when the cap is opposed to the nozzle opening surface and a peripheral portion (a lip portion) which extends integrally from the base portion and which is to come into close contact with the nozzle opening surface so as to surround the nozzles. The disclosed image recording apparatus further includes a mechanism for pressing the cap onto the nozzle opening surface.

In view of the recent demands for color printing capability and a higher operating speed of the ink-jet printer, the ink-jet head is arranged to eject inks of a plurality of colors or to have a large number of nozzles. Accordingly, in the image recording apparatus, the above-described cap may cover all of the nozzles. Alternatively, the nozzles may be divided into a plurality of groups depending upon the, color of the ink and a plurality of caps may respectively and individually cover the nozzles of the corresponding groups.

SUMMARY OF THE INVENTION

The cap is held in close or intimate contact with the nozzle opening surface owing to elastic deformation of its peripheral portion. Accordingly, due to collapse of the peripheral portion when the peripheral portion contacts the nozzle opening surface and restoration of the peripheral portion when the peripheral portion becomes distant from the nozzle opening surface, there is caused a change in a volume of a space between an inside of the cap and the nozzle opening surface that is fluid-tightly closed by the cap, i.e., a volume of an internal space. Where a pressure which results from the volume change is larger than a breakdown pressure of meniscuses of the ink, the meniscuses of the ink formed in nozzles may be broken. If the ink meniscuses are broken in a state in which the inside of the ink-jet head is subjected to a negative pressure such as a state in which a level of the ink surface in an ink supply source is located at a lower position than the nozzles, for instance, the ink is drawn into the head together with the outside air, rendering subsequent ink ejection difficult.

Where the nozzles that are to be covered by the cap are divided into groups depending upon the nozzle diameter or the physical property of the ink such as surface tension, the breakdown pressure of the ink meniscuses may differ from nozzles of one group to nozzles of another group. Accordingly, even when the caps corresponding to the respective groups of nozzles undergo the same degree of volume change, the nozzles belonging to one of the groups in which the breakdown pressure of the ink meniscuses is low tend to suffer from ink ejection failure due to breakdown or destruction of the ink meniscuses.

Depending upon a manner of grouping of the nozzles, the size of the plurality of caps may differ from each other and accordingly the perimeter of the peripheral portions of the respective caps (i.e., the contact area of the peripheral portions of the respective caps with the nozzle opening surface) may differ from each other. In this instance, even where the plurality of caps are pressed onto the nozzle opening surface by the same magnitude of force, the cap having a larger perimeter undergoes a smaller volume change of the internal space that is fluid-tightly closed by the cap, namely, undergoes a smaller pressure, because the force is distributed over the large area of contact of the peripheral portion with the nozzle opening surface. Accordingly, for permitting all of the caps to be held in sufficiently close contact with the nozzle opening surface, i.e., for permitting all of the caps to exhibit a sufficiently high degree of sealing with respect to the nozzle opening surface, it is needed to increase the pressing force for pressing the caps toward the nozzle opening surface, up to a degree at which the cap having a larger perimeter can be brought into sufficiently close contact with the nozzle opening surface. However, if the power of a drive mechanism is raised to increase the pressing force, the following problems may be caused: The cost of the drive mechanism may be inevitably pushed up. Where the ink-jet head is of a plate type having a relatively small degree of rigidity, the ink-jet head may suffer from deformation or distortion in the plate thickness due to the increased pressing force for pressing the caps toward the nozzle opening surface.

The above-indicated problems are mere examples of various problems experienced in the conventional image recording apparatus which is arranged such that the nozzles are divided into a plurality of groups and such that the caps respectively cover the nozzles of the corresponding groups. The conventional image recording apparatus experiences various other problems and there is much room for improvement. Accordingly, if any of the various problems are solved, it is possible to improve the utility of the image recording apparatus. The invention has been developed in the light of such situations. It is therefore an object of the invention to provide an image recording apparatus with high utility.

To solve the above-indicated problems, the present invention provides an image recording apparatus comprising: an ink-jet head having a plurality of nozzles which are open in a surface thereof-so as to provide a nozzle opening surface and through which ink is ejected, the plurality of nozzles being divided into a plurality of nozzle groups: and a plurality of caps which are provided in correspondence with the plurality of nozzle groups, each of which is formed of an elastic material, each of which has a peripheral portion that comes into close contact with the nozzle opening surface at an end thereof, and which are capable of covering the nozzle opening surface such that the peripheral portion of each of the plurality of caps surrounds nozzles which constitute a part of the plurality of nozzles and which belong to a corresponding one of the plurality of nozzle groups, wherein a first cap among the plurality of the caps has a hardness higher than that of a second cap which is different from the first cap. Namely, the plurality of caps are constituted by including two caps having mutually different hardness degrees.

Here, "hardness" of a cap may be interpreted, for instance, as a concept of a degree of resistance of the cap to deformation during its actual use. More specifically described, the hardness of the cap may be defined as a degree of deformation of the cap, when the cap is pressed onto the nozzle opening surface by a certain magnitude of force, for instance. Where the cap is hard, the cap is not likely to be deformed and the amount of deformation is small. On the contrary, where the cap is soft, the cap is likely to be deformed and the amount of deformation is large. As a technique of making the hardness of the caps different from each other, it is possible to employ a technique of varying hardness of the elastic material for forming each cap, as explained below, for instance. Alternatively, it is possible to employ a technique of varying the shape of each cap, e.g., the shape of the peripheral portion of each cap. Described more specifically, the thickness of each cap may be increased, whereby the cap becomes hard. On the other hand, the thickness of each cap may be decreased, whereby the cap becomes soft.

In the image recording apparatus according to the present invention, two of the plurality of caps are focused. One of those two caps is referred to as "a first cap" while the other of the two caps is referred to as "a second cap". Where the image recording apparatus has two caps, the two caps have mutually different hardness degrees. Where the image recording apparatus has three or more caps, the hardness of other caps except for the two caps is not particularly limited. For instance, the other caps except for the two caps may have the same hardness as the first cap or the second cap. Further, the other caps may have the hardness different from those of the first and the second caps.

According to the present image recording apparatus, it is possible to make appropriate the hardness degrees of the individual caps belonging to the respective nozzle groups. More specifically explained, it is possible to vary the hardness degrees of the individual caps depending upon various factors such as the shape of the nozzles, the property of the ink to be ejected from the nozzles, the arrangement of the nozzles, etc. Therefore, the image recording apparatus has improved performance, improved characteristics, etc., in various aspects.

The present image recording apparatus can be practiced in various forms such as those listed below, in conjunction with factors which are relied upon for varying the hardness degrees of the two caps from each other.

The present image recording apparatus may be practiced, for instance, in a form in which the hardness degrees of the two caps are made different from each other depending upon a breakdown pressure of meniscuses of the ink to be ejected from the plurality of nozzles that are divided into a plurality of nozzle groups. More specifically explained, the first cap corresponding to one of the plurality of nozzle groups which is constituted by the nozzles in which the breakdown pressure of the ink meniscuses formed therein is low has the hardness higher than that of the second cap corresponding to one of the plurality of nozzle groups which is constituted by the nozzles in which the breakdown pressure of the ink meniscuses formed therein is high. In general, because a cap with low hardness is likely to be deformed more easily than a cap with high hardness, the cap with low hardness assures close or intimate contact, that is, good sealing, with respect to the nozzle opening surface. However, the cap with low hardness undergoes a large volume change of the internal space that is fluid-tightly closed by the cap when the cap comes into close contact with the nozzle opening surface, resulting in easy breakdown or destruction of the ink meniscuses. According to the present form, the hardness of the caps can be made appropriate depending upon the degree of the breakdown pressure of the ink meniscuses. Therefore, for the nozzles in which the breakdown pressure of the ink meniscuses formed therein is low, the breakdown of the ink meniscuses can be prevented with high reliability while assuring a suitable degree of sealing exhibited by the cap. At the same time, for the nozzles in which the breakdown pressure of the ink meniscuses formed therein is high, the cap can exhibits good sealing within a range in which the breakdown of the ink meniscuses can be prevented. Here, "breakdown pressure of the ink meniscuses" means a degree of resistance of the ink meniscuses to breakdown. In other words, the breakdown pressure of the ink meniscuses means the ability of the nozzles to retain the meniscuses, the self-retaining ability of the ink meniscuses, and the like.

The present image recording apparatus may be practiced, for instance, in a form in which the hardness degrees of the two caps are made different from each other depending upon the diameter of the plurality of nozzles that are divided into a plurality of nozzle groups. More specifically explained, the first cap corresponding to one of the plurality of nozzle groups which is constituted by the nozzles whose diameter is large has the hardness higher than that of the second cap corresponding to one of the plurality of nozzle groups which is constituted by the nozzles whose diameter is small. Because the breakdown pressure of the ink meniscuses formed in the nozzles having a small diameter is high, those nozzles are covered by the cap which is softer or which has a lower hardness selected within a range in which the breakdown of the ink meniscuses can be prevented, thereby assuring a high degree of sealing. On the other hand, because the breakdown pressure of the ink meniscuses formed in the nozzles having a large diameter is low, those nozzles are covered by the cap which is harder or which has a higher hardness selected with a range in which good sealing is ensured, thereby preventing the breakdown of the ink meniscuses with high reliability.

The present image recording apparatus may be practiced, for instance, in a form in which the hardness degrees of the two caps are made different from each other depending upon the surface tension of the ink to be ejected from the plurality of nozzles that are divided into a plurality of nozzle groups. More specifically explained, the first cap corresponding to one of the plurality of nozzle groups which is constituted by the nozzles from which the ink with low surface tension is ejected has the hardness higher than that of the second cap corresponding to one of the plurality of nozzle groups which is constituted by the nozzles from which the ink with high surface tension is ejected. Because the breakdown pressure of the ink meniscuses formed in the nozzles from which the ink with high surface tension is ejected is high, those nozzles are covered by the cap which is softer or which has a lower hardness selected within a range in which the breakdown of the ink meniscuses can be prevented, thereby assuring a high degree of sealing. On the other hand, because the breakdown pressure of the ink meniscuses formed in the nozzles from which the ink with low surface tension is ejected is low, those nozzles are covered by the cap which is harder or which has a higher hardness selected with a range in which good sealing is ensured, thereby preventing the breakdown of the ink meniscuses with high reliability.

The present image recording apparatus may be practiced, for instance, in a form in which the hardness degrees of the two caps are made different from each other depending upon the perimeter of the peripheral portion of the cap. More specifically explained, the first cap having a smaller perimeter has the hardness higher than that of the second cap having a larger perimeter. According to this form, a relatively soft rubber-like elastic material having a low hardness is selected for the cap in which the peripheral portion has a larger perimeter (i.e., in which the contact area of the peripheral portion with the nozzle opening surface-is large). On the other hand, a relatively hard rubber-like elastic material having a high hardness is selected fir the cap in which the peripheral portion has a smaller perimeter (i.e., in which the area of contact of the peripheral portion with the nozzle opening surface is small). If the cap whose peripheral portion has a larger perimeter and the cap whose peripheral portion has a smaller perimeter are moved toward and away from the nozzle opening surface by the same drive mechanism, both of the caps are pressed or urged onto the nozzle opening surface with the same magnitude of force. The pressing force is likely to be distributed in the cap whose peripheral portion has a larger perimeter, as compared with the cap whose peripheral portion has a smaller perimeter. As a result, the cap with a larger perimeter is not held in sufficiently close or intimate contact with the nozzle opening surface, that is, the cap with a larger perimeter does not assure sufficient sealing with respect to the nozzle opening surface. According to the present form, the cap whose peripheral portion has a larger perimeter is formed of a relatively soft rubber-like elastic material that is determined while taking account of a difference in the hardness between the cap with a larger perimeter and the cap with a smaller perimeter, whereby the cap with a larger perimeter is elastically deformed to a sufficient extent and accordingly exhibits good sealing with respect to the nozzle opening surface, even when the cap with a larger perimeter is brought into close contact with the nozzle opening surface by the same magnitude of pressing force for pressing the cap with a smaller perimeter.

In the form indicated above, it is not necessary to increase the biasing force (the pressing force) up to a level required for permitting the cap with a larger perimeter to exhibit sufficient sealing with respect to the nozzle opening surface, thereby obviating a cost increase which arises from the increase in the power of the drive mechanism.

Further, in the form indicated above, the sealing of the cap with respect to the nozzle opening surface is enhanced without increasing the pressing force by the drive mechanism. Accordingly, where the ink-jet head is of a plate type with small thickness, it is possible to avoid deformation or distortion of the nozzle opening surface due to high pressing force, thereby obviating ink ejection failure which may result from the distortion of the nozzle opening surface.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENTS

There will be described in detail preferred embodiments of the present invention by reference to the accompanying drawings.

Figure 1:
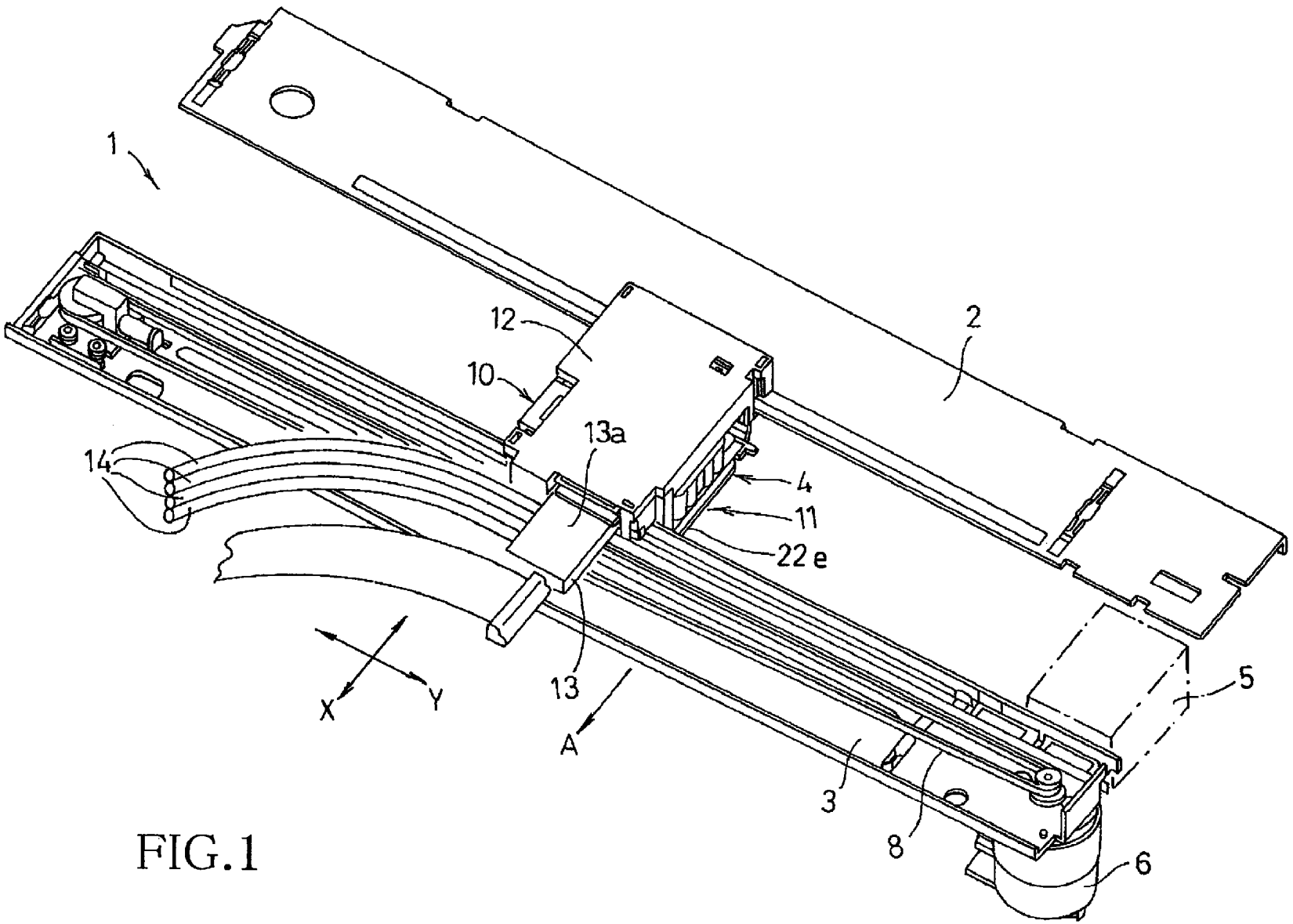
FIG. 1 is a perspective view showing principal parts of an image recording apparatus to which the principle of the present invention is applied.

Referring to FIGS. 1-7, there will be explained an image recording apparatus constructed according to a first embodiment of the present invention. As shown in FIG. 1, the present image recording apparatus has a recording portion 1 provided therein. Within the recording portion 1, there is disposed an ink-jet head unit 4 (hereinafter referred to as "recording head unit") from which ink is ejected to a sheet of paper as a recording medium for printing operation. The image recording apparatus is a multi-function device (MFD) having a printing function, a copying function, a scanning function and a facsimile function. The recording head unit 4 is mounted on an ink-jet printer that performs the printing function.

The recording portion 1 includes: the recording head unit 4 that constitutes a carriage which is slidably mounted on two elongate plate-like guide rails 2, 3 extending in a Y direction (i.e., a main scanning direction perpendicular to a sheet-feed direction), so as to be reciprocated in the Y direction; a timing belt 8 disposed, for reciprocating the recording head unit 4, on an upper surface of the guide rail 3 so as to be parallel with the guide rail 3 which is disposed on a downstream side (indicated by an arrow A in FIG. 1) of the recording head unit 4 as seen in an X direction (i.e., the sheet-feed direction and a sub scanning direction); and a carriage (CR) motor 6 for driving the timing belt 8.

At one end of the recording portion 1 (on the right side in FIG. 1) that is outside a record region corresponding to the width of the paper sheet to be fed, a maintenance device 5 is disposed. The position of the maintenance device 5 corresponds to a stand-by position of the recording head unit 4. The maintenance device 5 includes caps 7 shown in FIGS. 5 and 6B which are movable toward and away from a nozzle opening surface 22*e* of the recording head unit 4 in which nozzles 22 are formed. The image recording apparatus is arranged such that the caps 7 are connectable to a suction device 9 constituted by including a tube pump 91 for sucking poor-quality ink (such as thickened ink or solidified ink) and air-bubbles from the nozzles and such that the caps 7 are connectable to an ink absorber 92. The maintenance device 5 may further include a wiping device (not shown) for wiping the nozzle opening surface 22*e*.

In the present embodiment, the nozzles 22 of the recording head unit 4 are divided into two groups, and two caps, i.e., a first cap 7*a* and a second cap 7*b*, are provided for covering the nozzles 22 in the corresponding groups. To the first and second caps 7*a*, 7*b*, there are connected discharge passages 96*a*, 96*b*, respectively. A selector 93 to which the discharge passages 96*a*, 96*b* are connected is arranged to selectively connect the discharge passages 96*a*, 96*b* to the tube pump 91 and to bring both of the discharge passages 96*a*, 96*b* into communication with the ink absorber 92 at the same time. The first and second caps 7*a*, 7*b* are mounted on a support base 97 with respective coil springs as biasing members 95*a*, 95*b* interposed therebetween. The support base 97 is movable up and down, i.e., movable toward and away from the nozzle opening surface 22*e*, by a drive device not shown. When the first and second caps 7*a*, 7*b* abut on the nozzle opening surface 22*e*, the caps 7*a*, 7*b* are biased or urged toward the nozzle opening surface 22*e*.

Figure 2:
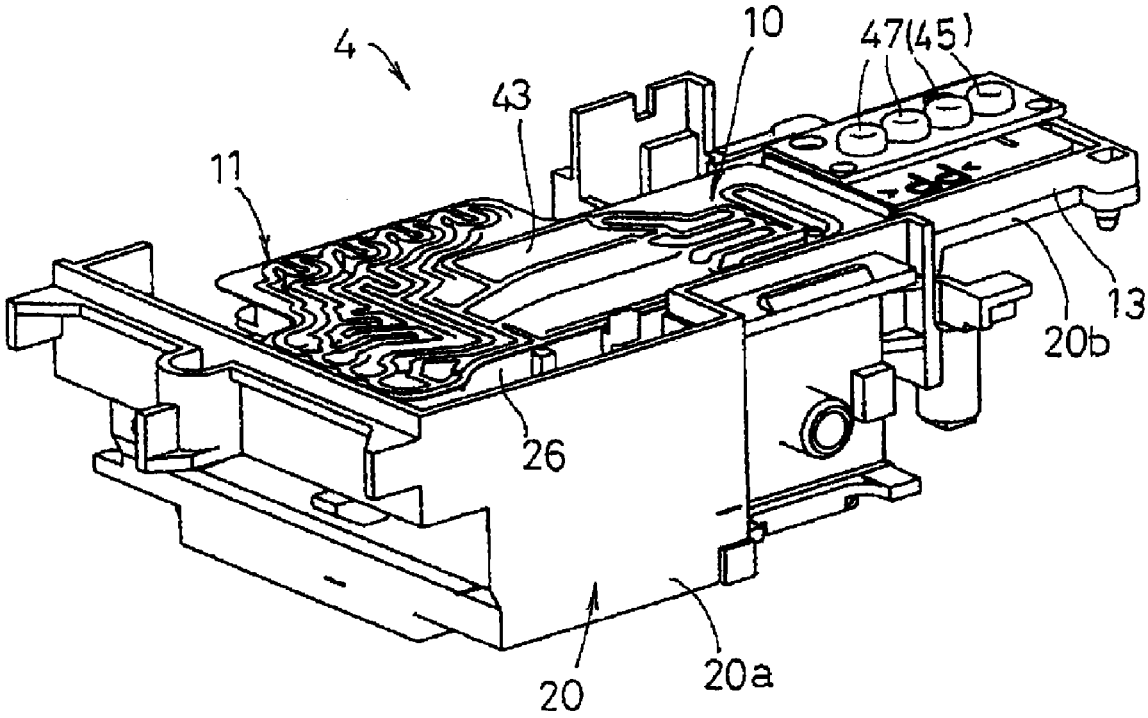
FIG. 2 is a perspective view of a recording head unit of the image recording apparatus of FIG. 1.
Figure 3:
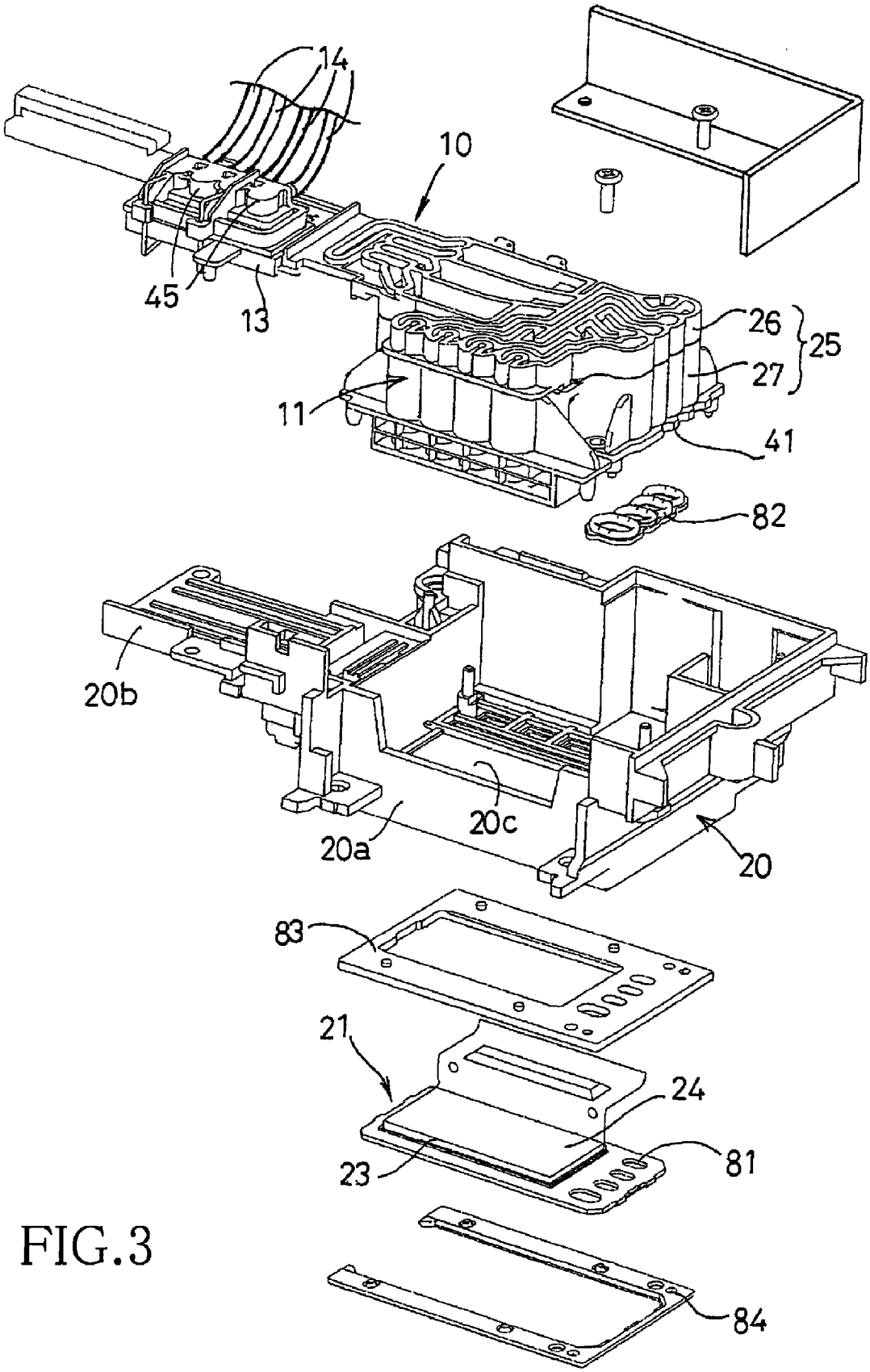
FIG. 3 is an exploded perspective view of the recording head unit of FIG. 2.
Figure 4:
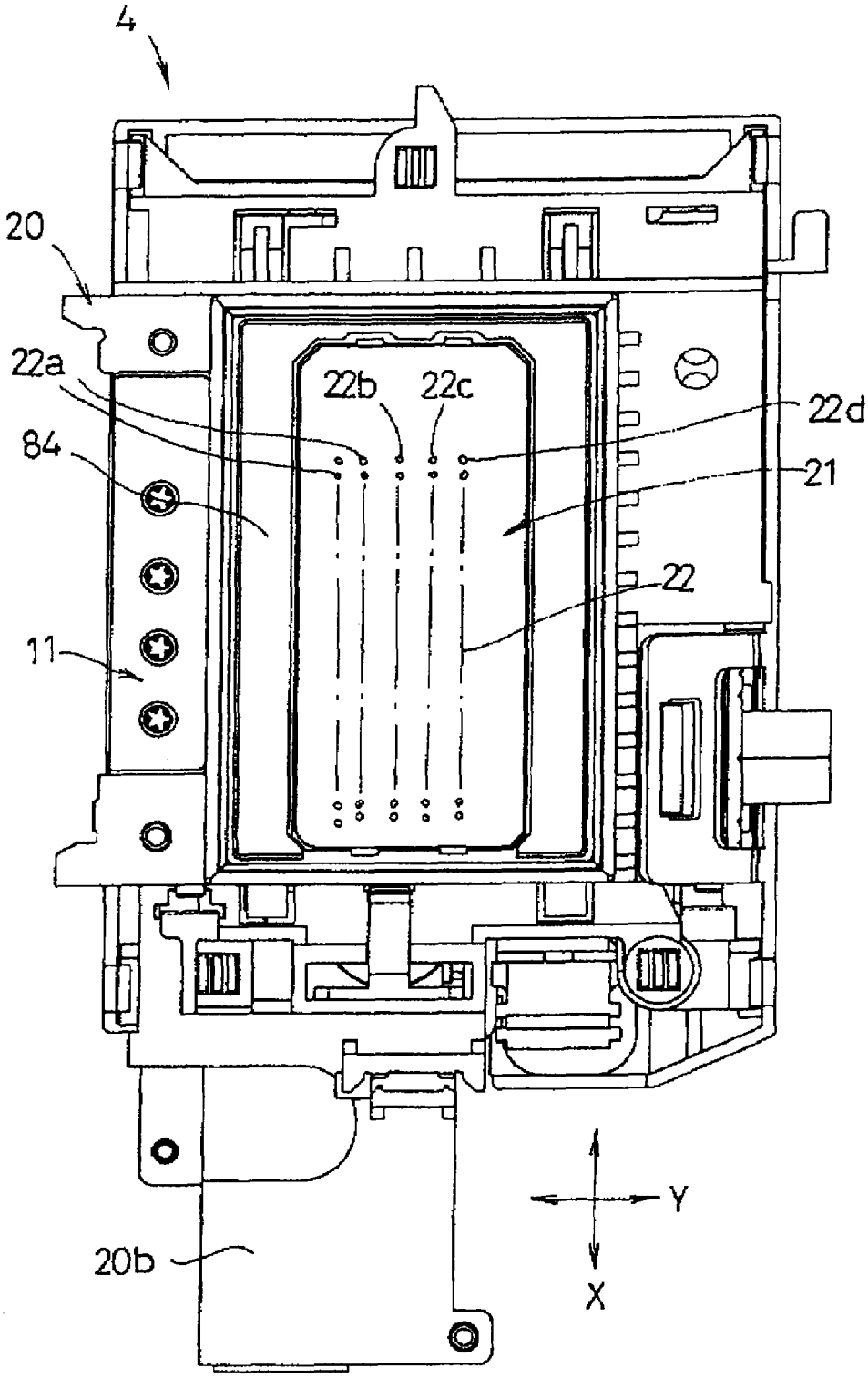
FIG. 4 is a bottom plan view of the recording head unit of FIG. 2.
Figure 5:
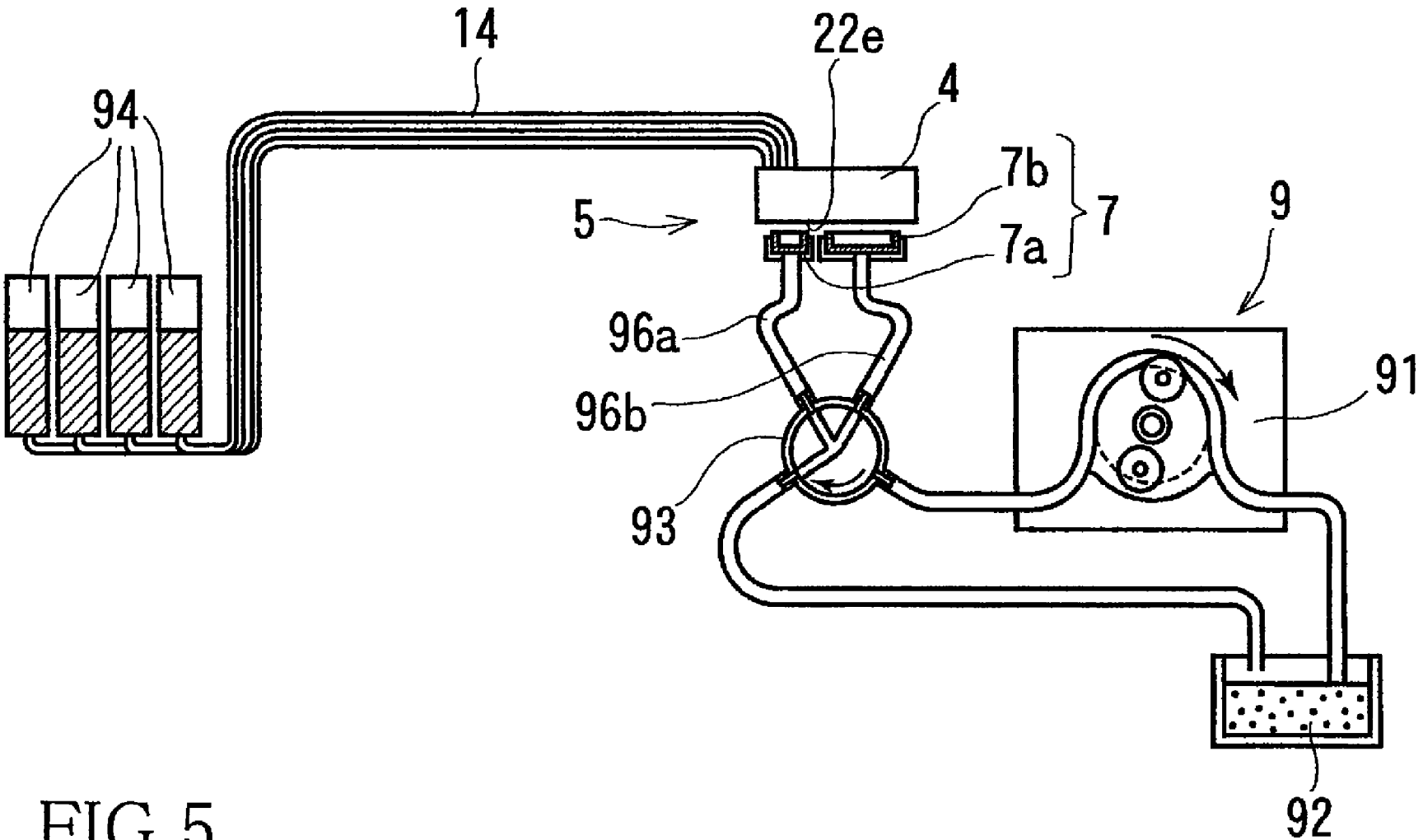
FIG. 5 is a view showing a maintenance device of the image recording apparatus.

As shown in FIGS. 2 and 3, the recording head unit 4 includes: a head holder 20 comprising a generally box-like main body portion 20*a*, an extending portion 20*b* that extends from the main body portion 20*a* toward a downstream side (indicated by the arrow A in FIG. 1) in the sheet-feed direction, and a bottom plate 20*c*; a recording head 21 of an ink-jet type fixedly positioned on a lower surface side of the bottom plate 20*c* of the head holder 20; and a damping device 10 and an air-discharge valve device 11 which are fixedly disposed on an upper side of the bottom plate 20*c*.

The damping device 10 has an extending portion 13 which extends substantially horizontally toward the downstream side in the sheet-feed direction (indicated by the arrow A in FIG. 1) and which is superposed on and supported by the extending portion 20*b* of the head holder 20. To the extending portion 13*a*, there are connected four ink tubes 14 at their distal ends. The image recording apparatus has, as ink supply sources, four ink tanks 94 (shown in FIG. 5) respectively storing yellow ink (Y), magenta ink (M), cyan ink (C), and a black ink (BK), which are disposed within a main frame for performing full-color recording. The ink tubes 14 are connected at their proximal ends to the respective ink tanks 94 and at their distal ends to respective ink-tube connection ports 47 of the damping device 10 via a joint member 45. In the image recording apparatus of the exemplary embodiment, the number of the inks to be used is four and accordingly the number of the ink tubes 14 is four. It is, however, noted that the kind of the ink to be used, the number of the ink tubes, etc., are not limited to those described above.

The recording head 21 has the nozzles 22 which are open in its lower surface. In the recording head unit 4, there are formed ink flow passages extending from the ink-tube connection ports 47 to the nozzles 22. The damping device 10 is provided in the route of the ink flow passages of the recording head unit 4 and is arranged to damp or absorb pressure fluctuation acting on the ink due to inertial force of the ink tubes 14 or the like, utilizing a damping effect by the air. The upper surface of the damping device 10 and the upper surface of the air-discharge valve device 11 are covered by a cover member 12 while the upper surface of the extending portion 13 is covered by a cover member 13*a*, as shown in FIG. 1. As the damping device 10 and the air-discharge valve device 11, those disclosed in US Patent Application Publication No. 2005/0088494 A1 corresponding to JP-A-2005-145051 and US Patent Application Publication No. 2005/0206691 A1 corresponding to JP-A-2005-262723 are preferable.

A large number of nozzles 22 formed in the lower surface of the recording head 21 are arranged in rows, that is, two nozzle-rows 22*a*, 22*a* for the black ink, one nozzle row 22*b* for the cyan ink, one nozzle row 22*c* for the yellow ink, and one nozzle row 22*d* for the magenta ink. These five nozzle rows 22*a*-22*d* are arranged in the order of description from the left side to the right side in FIG. 4 that shows the lower surface of the recording head 21. Each nozzle row extends in a direction perpendicular to a direction of the movement of the carriage (that is, in a direction perpendicular to the Y direction and the main scanning direction) and is opposed to the upper surface of the paper sheet as the recording medium. Thus, the lower surface of the recoding head 21 is formed as the nozzle opening surface 22*e* in which the nozzles 22 are formed.

Like recording heads disclosed in U.S. Pat. No. 6,729,717 (corresponding to JP-A-2002-67312) and JP-A-2001-219560, the recording head 21 has, at one end of its upper surface, four ink supply holes 81 for respective inks of the four colors. The inks are introduced into the recording head 21 through the ink supply holes 81 and are distributed into a multiplicity of pressure chambers via four ink supply channels (manifolds) for the respective four inks which extend from the ink supply holes 81. The inks are ejected from the nozzles 22 by driving an actuator 23 such as piezoelectric elements that correspond to the respective pressure chambers. As shown in FIG. 3, a flexible flat cable 24 is fixed to the upper surface of the actuator 23 for applying a voltage to the actuator 23. The recording head 21 is fixed to the lower surface of the bottom plate 20*c* of the head holder 20. For the purpose of preventing deflection of the recording head 21 when being fixed to the bottom plate 21*c*, there is interposed a reinforcing frame 83 between the recording head 21 and the bottom plate 20*c*. The head connection holes 41 of the damping device 10 are inserted into an opening of the bottom plate 20*c*. The ink supply holes 81 of the recording head 21 and the head connection holes 41 of the damping device 10 communicate with each other via respective openings formed in the reinforcing frame 83, with a seal member 82 such as a rubber packing interposed therebetween. Further, a generally U-shaped front frame 84 is fixed to the nozzle opening surface 22*e* (the lower surface) of the recording head 21 to avoid formation of a step in the nozzle opening surface 22*e*.

Figure 6A:
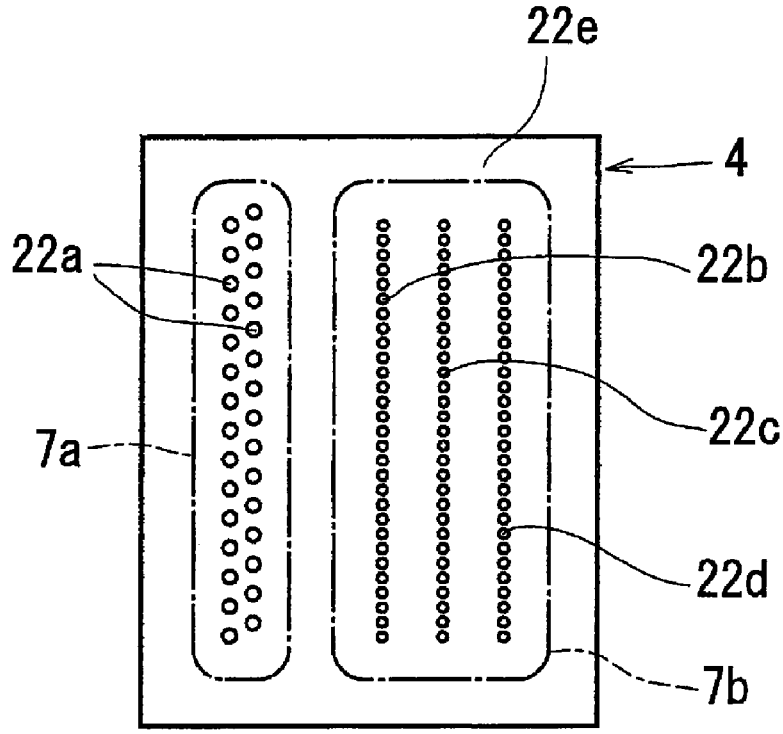
FIG. 6A is a plan view showing an arrangement of nozzles according to a first embodiment and FIG. 6B is a view in partially vertical cross section showing a state in which the nozzle opening surface is covered by caps.

There will be next explained details of the nozzles 22 and the two caps 7*a*, 7*b*. In the exemplary embodiment, the five nozzles rows 22*a*, 22*a*, 22*b*, 22*c*, 22*d* are arranged on the lower surface of the recording head 21. As shown in FIG. 6A, each nozzle 22 for the black ink has a diameter (an inside diameter) larger than that of each of the nozzles 22 for the inks of other three colors, i.e., cyan, magenta, and yellow, in consideration of a higher frequency of use of the black ink in text recording than in image recording.

In the light of the above, the nozzles 22 are divided into two groups consisting of a first group including the nozzles 22 of the two rows 22*a*, 22*a* for the black ink and a second group including the nozzles 22 of other three rows 22*b*, 22*c*, 22*d* for the cyan ink, the yellow ink, and the magenta ink, respectively. The first cap 7*a* is to cover the nozzles 22 for the black ink in the first group while the second cap 7*b* is to cover the nozzles 22 for the inks of the other three colors in the second group. Each of the first and second caps 7*a*, 7*b* has a base portion 71 which is located apart from the nozzle opening surface 22*e* when the caps 7*a*, 7*b* cover the nozzle opening surface 22*e* and a peripheral portion 72 which extends integrally from the base portion 71 and which comes into close contact with the nozzle opening surface 22*e* at one end thereof so as to surround the nozzles of the corresponding group. The above-indicated discharge passages 96*a*, 96*b* are connected to the base portions 71 of the respective caps 7*a*, 7*b*.

Figure 7:
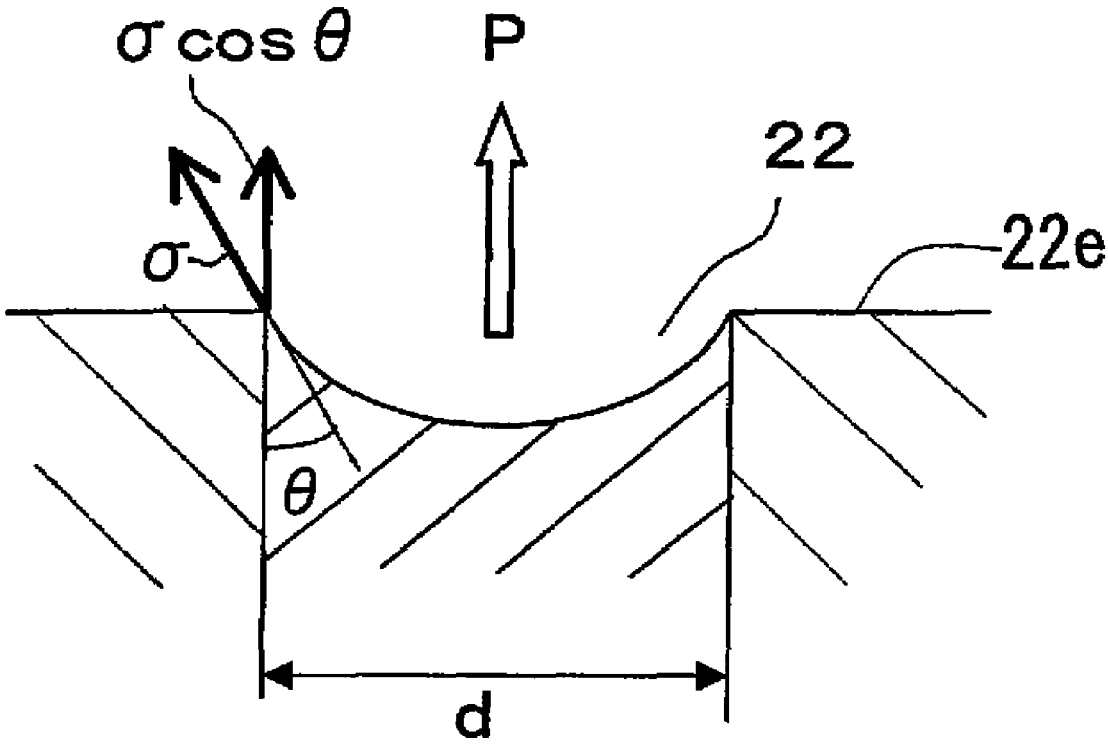
FIG. 7 is a view for explaining an ink meniscus formed in a nozzle.

As shown in FIG. 7, a breakdown pressure P of a meniscus of the ink formed in each nozzle 22 is represented by the following formula:

$$P=(4\sigma \cos \theta)/d$$

wherein "σ" represents surface tension of ink, "d" represents a nozzle diameter, and "θ" represents a contact angle. Accordingly, the breakdown pressure P of the ink meniscus decreases with an increase in the nozzle diameter d. Therefore, in the exemplary first embodiment, the breakdown pressure of the ink meniscus formed in each nozzle 22 for the black ink having a larger diameter is smaller than the breakdown pressure of the ink meniscus formed in each nozzle 22 for the inks of the other colors.

In view of the above, the first cap 7*a* corresponding to the nozzles 22 for the black ink is formed of a relatively hard rubber-like elastic material having a higher hardness than that of the second cap 7*b* corresponding to the nozzles for the inks of the other three colors. According to this arrangement, the first cap 7*a* is made harder than the second cap 7*b*. Therefore, the first cap 7*a* is less likely to be collapsed within a range in which close or intimate contact of the first cap 7*a* with the nozzle opening surface 22*e* is ensured when the first cap 7*a* abuts on the same 22*e*, whereby the volume change of the internal space of the first cap 7 is suppressed to thereby prevent the breakdown or destruction of the ink meniscuses.

Meanwhile, the breakdown pressure of the ink meniscuses formed in the nozzles 22 for the inks of the three colors other than black is high. Accordingly, it is not necessary to select, as the elastic material for the second cap 7*b* corresponding to the nozzles 22 for the inks of the three colors, the relatively hard rubber-like elastic material, in conformity with the first cap 7*a*. Namely, the second cap 7*b* is formed using a relatively soft elastic material selected within a range in which the breakdown of the ink meniscuses can be avoided, that is, the second cap 7*b* is made relatively soft, thereby permitting the second cap 7*b* to exhibit sufficiently high sealing with respect to the nozzle opening surface 22*e*.

Thus, the hardness of the elastic material for each of the plurality of caps is selected depending upon the breakdown pressure of the ink meniscuses formed in the nozzles of the corresponding group. Accordingly, the stability of the ink ejection performance of the ink-jet head can be enhanced even where the ink-jet head has a plurality of nozzle groups which differ from each other in the breakdown pressure of the ink meniscuses.

Figure 8:
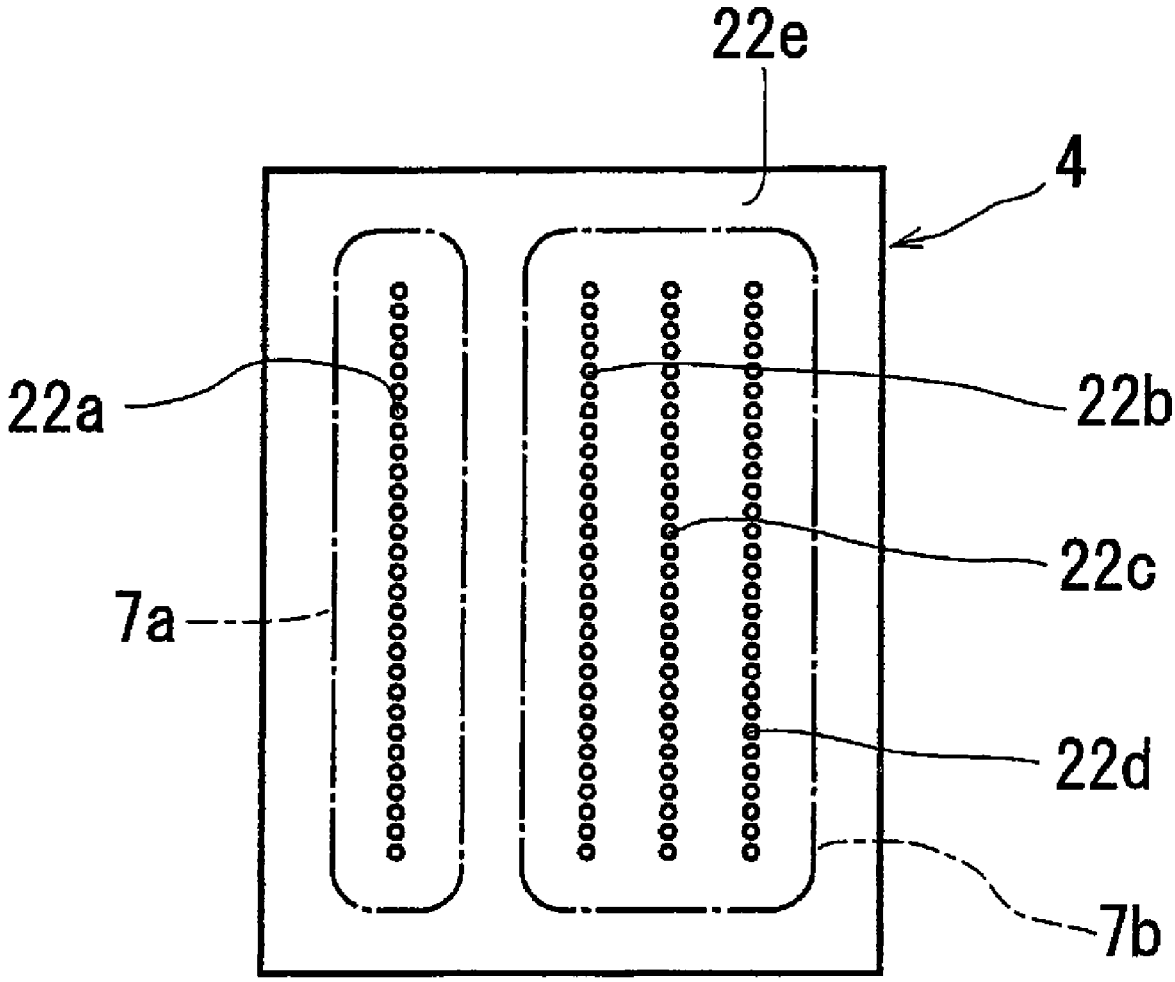
FIG. 8 is a plan view showing an arrangement of nozzles according to a second embodiment.

Referring next to FIG. 8, there will be explained a second embodiment of the invention. As the second embodiment is a modification of the first embodiment, the same reference numerals as used in the first embodiment are used to identify the corresponding components, and a detailed explanation of which is dispensed with.

In the exemplary second embodiment, the nozzles 22 are arranged in four rows in total, i.e., one row 22*a* for the black ink, one row 22*b* for the cyan ink, one row 22*c* for the yellow ink, and one row 22*d* for the magenta ink. The caps 7*a*, 7*b* cover the nozzle opening surface 22*e* such that the first cap 7*a* corresponds to the black-ink nozzle rows 22*a* and such that the second cap 7*b* corresponds to the cyan-ink nozzle row 22*b*, the yellow-ink nozzle row 22*c*, and the magenta-ink nozzle row 22*d*. In the second embodiment, as the composition of the black ink differs from those of the other three inks (cyan ink, yellow ink, and magenta ink), the surface tension $\sigma$ of the black ink is lower than those of the other three inks.

As apparent from the above-indicated formula and FIG. 7, the breakdown pressure P of the ink meniscus decreases with a decrease in the surface tension $\sigma$. Accordingly, the breakdown pressure of the meniscuses of the black ink is lower than those of the other three inks. In view of this, the first cap 7*a* is formed using a material harder than that for the second cap 7*b* which is selected within a range in which the first cap 7*a* can exhibit sufficient sealing with respect to the nozzle opening surface 22*e*. According to the arrangement, the first cap 7*a* is made harder than the second cap 7*b* and therefore is unlikely to be collapsed, whereby the volume change of the internal space of the first cap 7*a* is made small for thereby obviate the breakdown of the ink meniscuses. As the second cap 7*b* corresponds to the nozzles in which the breakdown pressure of the ink meniscuses is high, it is not necessary to select, as the material for the second cap 7*b*, a hard rubber-like elastic material, in conformity with the first cap 7*a*. Namely, the second cap 7*b* is formed using a soft material that assures sufficient sealing within a range in which the ink meniscuses are not broken. In other words, the second cap 7*b* is made comparatively soft.

In the illustrated first and second embodiments, the size of the first cap 7*a* corresponding to the nozzles in which the breakdown pressure of the ink meniscuses is low is smaller than the size of the second cap 7*b* corresponding to the nozzles in which the breakdown pressure of the ink meniscuses is high. That is, the size of the peripheral portion 71 of the first cap 7*a* is smaller than that of the peripheral portion 71 of the second cap 7*b* and the perimeter of the peripheral portion 72 of the first cap 7*a* is smaller than that of the peripheral portion 72 of the second cap 7*b*. The configurations and structures of the first and second caps 7*a*, 7*b* are not limited to those illustrated above. The size of a cap corresponding to the nozzles in which the breakdown pressure of the ink meniscuses formed therein is low may be larger than or equal to the size of a cap corresponding to the nozzles in which the breakdown pressure of the ink meniscuses formed therein is high. As in the illustrated first and second embodiments, in these instances, the hardness of the rubber-like elastic material for each cap is selected depending upon the breakdown pressure of the ink meniscuses so as to satisfy both of prevention of the breakdown of the ink meniscuses and good sealing with respect to the nozzle opening surface. Namely, the hardness of the cap is made appropriate, assuring the advantages similar to those in the illustrated first and second embodiments.

Figure 6B:
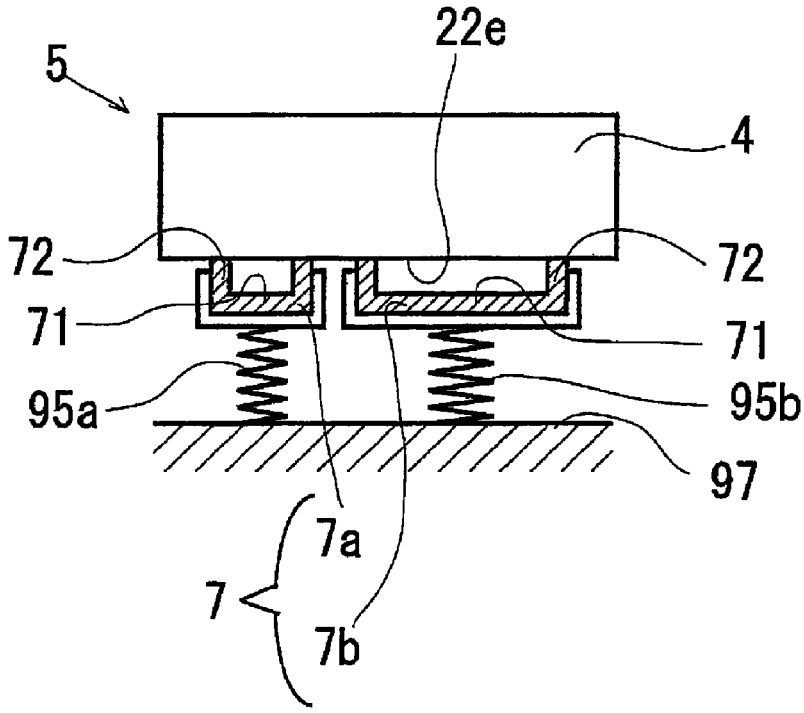

Next, there will be explained a third embodiment with reference to FIGS. 6B and 8.

The third embodiment is identical with the illustrated first and second embodiments in that the plurality of caps have mutually different sizes, that is, the plurality of caps have respective peripheral portions that have mutually different perimeters. However, the third embodiment differs from the illustrated first and second embodiments in that the breakdown pressure of the ink meniscuses is common to all of the nozzles, that is, all of the nozzles have the same diameter and all of the inks have the same physical property. In detail, in the third embodiment, the first cap 7*a* has the peripheral portion 72 whose perimeter is smaller than that of the peripheral portion 72 of the second cap 7*b*, so that the contact area of the first cap 7 with the nozzle opening surface 22*e* is smaller, as compared with the second cap 7*b*. As shown in FIG. 6B, the first and second caps 7*a*, 7*b* are mounted to the support base 97 which is moved up and down by a drive mechanism not shown, via the biasing members 95*a*, 95*b*, respectively.

In the arrangement described above, the first cap 7*a* and the second cap 7*b* are pressed onto the nozzle opening surface 22*e* by the same magnitude of the biasing or pressing force. Where the material for the first cap 7*a* and the material for the second cap 7*b* have the same hardness, the pressing force is distributed in the second cap 7*b* due to the larger perimeter of the peripheral portion 72 that comes into close contact with the nozzle opening surface 22*e*, that is, due to the larger contact area of the peripheral portion 72 with the nozzle opening surface 22*e*. As a result, the second cap 7*b* exhibits less sealing with respect to the nozzle opening surface 22*e* than the first cap 7*a*. In view of the above, in the third embodiment, the second cap 7*b* is formed using a relatively soft rubber-like elastic material having a lower hardness than the material of the first cap 7*a*, whereby the second cap 7*b* is made relatively soft. Therefore, the second cap 7*b* is likely to be collapsed when the two caps 7*a*, 7*b* are pressed with the same magnitude of pressing force, thereby permitting the second cap 7*b* to exhibit good sealing.

In the above-described arrangement, each of the plurality of caps assures good sealing by selecting a suitable rubber-like elastic material having a suitable hardness depending upon the perimeter of the peripheral portion of each cap, i.e., by making the hardness of each cap appropriate, even where the plurality of caps include a cap such as the second cap 7*b* which provides insufficient sealing with respect to the nozzle opening surface 22*e* due to the larger perimeter of its peripheral portion. In general, the degree of sealing increases with an increase in the pressing force per unit area for pressing the caps onto the nozzle opening surface 22*e*. When the pressing force is increased by increasing the power of the drive mechanism, there is generated a force that distorts the nozzle opening surface 22*e* at a portion thereof corresponding to the second cap 7*b* whose peripheral portion 72 has a long perimeter and therefore has a large area of contact with the nozzle opening surface 22*e*. In this instance, the portion of the nozzle opening surface 22*e* corresponding to the second cap 7*b* may be distorted or deformed, resulting in ink ejection failure. Accordingly, in the present embodiment, the second cap 7*b* whose peripheral portion 72 has a long perimeter is formed of-a soft material for assuring good sealing with respect to the nozzle opening surface 22*e* when the second cap 7*b* comes into close contact therewith. Therefore, the arrangement prevents the deformation of the nozzle opening surface 22*e* and eliminates a cost-taking procedure of increasing the power of the drive mechanism for increasing the pressing power.

While the two caps 7*a*, 7*b* are provided in the illustrated first through third embodiments, three or more caps may be provided. In this instance, the hardness of the rubber-like material for the caps may be made different in steps depending upon the degree of the breakdown pressure of the ink meniscuses or the perimeter of the peripheral portion as explained above. In the illustrated first through third embodiments, the hardness of the first cap 7*a* and the hardness of the second cap 7*b* are made different from each other by varying the hardness of the rubber-like elastic material for each cap. The hardness of the first cap 7*a* and the hardness of the second cap 7*b* may be made different from each other by varying the shape of each cap. More specifically described, the first cap 7*a* may be made harder than the second cap 7*b* by increasing the thickness of the peripheral portion 72 of the first cap 7*a* or by decreasing the thickness of the peripheral portion 72 of the second cap 7*b*, for instance.

In the illustrated embodiments, the single recording head unit 4 includes the single recording, head 21, and the plurality of nozzles formed in the single recording head 21 are divided into groups, whereby each of the plurality of caps covers the nozzles of the corresponding group. The principle of the invention may be applicable to an arrangement wherein the single recording head unit 4 includes a plurality of recording heads 21 and the nozzles formed in each recording head 21 are divided into a plurality of groups, whereby each of the plurality of caps covers the nozzles in the corresponding group.

While the preferred embodiments of the present invention have been described above, it is to be understood that the invention is not limited to the details of the illustrated embodiments, but may be embodied with various other changes and modifications, which may occur to those skilled in the art, without departing from the spirit and scope of the invention.

What is claimed is:

1. An image recording apparatus comprising:

an ink-jet head having a plurality of nozzles which are open in a surface thereof so as to provide a nozzle opening surface and through which ink is ejected, the plurality of nozzles being divided into a plurality of nozzle groups; and a plurality of caps which are provided in correspondence with the plurality of nozzle groups, each of which is formed of an elastic material, each of which has a peripheral portion that comes into close contact with the nozzle opening surface at an end thereof, and which are capable of covering the nozzle opening surface such that the peripheral portion of each of the plurality of caps surrounds nozzles which constitute a part of the plurality of nozzles and which belong to a corresponding one of the plurality of nozzle groups, wherein a first cap among the plurality of caps has a hardness higher than that of a second cap which is different from the first cap, wherein the elastic material of the first cap is harder than the elastic material of the second cap.

2. The image recording apparatus according to claim 1, wherein the elastic material of each of the plurality of caps is rubber or the like.

3. The image recording apparatus according to claim 1, wherein a breakdown pressure of ink meniscuses formed in nozzles which constitute a part of the plurality of nozzles and which belong to one of the plurality of nozzle groups that corresponds to the first cap is lower than a breakdown pressure of ink meniscuses formed in nozzles which constitute a part of the plurality of nozzles and which belong to one of the plurality of nozzle groups that corresponds to the second cap.

4. The image recording apparatus according to claim 1, wherein each of the nozzles which constitute a part of the plurality of nozzles and which belong to one of the plurality of nozzle groups that corresponds to the first cap has a diameter larger than that of each of the nozzles which constitute a part of the plurality of nozzles and which belong to one of the plurality of nozzle groups that corresponds to the second cap.

5. The image recording apparatus according to claim 1, wherein a surface tension of the ink to be ejected from nozzles which constitute a part of the plurality of nozzles and which belong to one of the plurality of nozzle groups that corresponds to the first cap is smaller than a surface tension of the ink to be ejected from nozzles which constitute a part of the plurality of nozzles and which belong to one of the plurality of nozzle groups that corresponds to the second cap.

6. The image recording apparatus according to claim 1, wherein the peripheral portion of the first cap has a perimeter smaller than that of the peripheral portion of the second cap.

7. The image recording apparatus according to claim 1, wherein each of the plurality of caps has a base portion which is located apart from the nozzle opening surface of the ink-jet head when said each the plurality of caps covers the nozzle opening surface, and wherein the peripheral portion of said each of the plurality of caps is formed integrally with the base portion and extends in a direction intersecting the base portion.

8. The image recording apparatus according to claim 1, wherein each of the plurality of caps covers the nozzle opening surface of the ink-jet head such that said each of the plurality of caps is pressed onto the nozzle opening surface.

9. The image recording apparatus according to claim 8, wherein a degree of collapse of the peripheral portion of the first cap resulting from being pressed onto the nozzle opening surface is lower than a degree of collapse of the peripheral portion of the second cap resulting from being pressed onto the nozzle opening surface.

10. The image recording apparatus according to claim 8, wherein a change in a volume of an internal space of the first cap resulting from being pressed onto the nozzle opening surface is smaller than a change in a volume of an internal space of the second cap resulting from being pressed onto the nozzle opening surface.

11. The image recording apparatus according to claim 1, further comprising a cap-driving mechanism which moves the plurality of caps toward and away from the nozzle opening surface of the ink-jet head and which presses the plurality of caps onto the nozzle opening surface, for permitting the plurality of caps to cover the nozzle opening surface.

12. The image recording apparatus according to claim 1, further comprising at least one of an ink absorber for absorbing ink and a suction device for sucking ink from the plurality of nozzles, wherein each of the plurality of caps includes an outlet for discharging ink therethrough, and wherein the internal space of each of the plurality of caps and at least one of the ink absorber and the suction device communicates with each other via the outlet of said each of the plurality of caps.

13. An image recording apparatus comprising:

an ink-jet head having a plurality of nozzles which are open in a surface thereof so as to provide a nozzle opening surface and through which ink is ejected, the plurality of nozzles being divided into a plurality of nozzle groups; and a plurality of caps which are provided in correspondence with the plurality of nozzle groups, each of which is formed of an elastic material, each of which has a peripheral portion that comes into close contact with the nozzle opening surface at an end thereof, and which are capable of covering the nozzle opening surface such that the peripheral portion of each of the plurality of caps surrounds nozzles which constitute a part of the plurality of nozzles and which belong to a corresponding one of the plurality of nozzle groups, wherein a first cap among the plurality of caps has a hardness higher than that of a second cap which is different from the first cap because a thickness of a peripheral portion of the first cap is larger than a thickness of a peripheral portion the second cap.

14. The image recording apparatus according to claim 13, wherein the elastic material of the first cap is harder than that of the second cap.

15. The image recording apparatus according to claim 13, wherein the elastic material of each of the plurality of caps is rubber or the like.

16. The image recording apparatus according to claim 13, wherein a breakdown pressure of ink meniscuses formed in nozzles which constitute a part of the plurality of nozzles and which belong to one of the plurality of nozzle groups that corresponds to the first cap is lower than a breakdown pressure of ink meniscuses formed in nozzles which constitute a part of the plurality of nozzles and which belong to one of the plurality of nozzle groups that corresponds to the second cap.

17. The image recording apparatus according to claim 13, wherein each of the nozzles which constitute a part of the plurality of nozzles and which belong to one of the plurality of nozzle groups that corresponds to the first cap has a diameter larger than that of each of the nozzles which constitute a part of the plurality of nozzles and which belong to one of the plurality of nozzle groups that corresponds to the second cap.

18. The image recording apparatus according to claim 13, wherein a surface tension of the ink to be ejected from nozzles which constitute a part of the plurality of nozzles and which belong to one of the plurality of nozzle groups that corresponds to the first cap is smaller than a surface tension of the ink to be ejected from nozzles which constitute a part of the plurality of nozzles and which belong to one of the plurality of nozzle groups that corresponds to the second cap.

19. The image recording apparatus according to claim 13, wherein the peripheral portion of the first cap has a perimeter smaller than that of the peripheral portion of the second cap.

20. The image recording apparatus according to claim 13, wherein each of the plurality of caps has a base portion which is located apart from the nozzle opening surface of the ink-jet head when said each the plurality of caps covers the nozzle opening surface, and wherein the peripheral portion of said each of the plurality of caps is formed integrally with the base portion and extends in a direction intersecting the base portion.

21. The image recording apparatus according to claim 13, wherein each of the plurality of caps covers the nozzle opening surface of the ink-jet head such that said each of the plurality of caps is pressed onto the nozzle opening surface.

22. The image recording apparatus according to claim 21, wherein a degree of collapse of the peripheral portion of the first cap resulting from being pressed onto the nozzle opening surface is lower than a degree of collapse of the peripheral portion of the second cap resulting from being pressed onto the nozzle opening surface.

23. The image recording apparatus according to claim 21, wherein a change in a volume of an internal space of the first cap resulting from being pressed onto the nozzle opening surface is smaller than a change in a volume of an internal space of the second cap resulting from being pressed onto the nozzle opening surface.

24. The image recording apparatus according to claim 21, further comprising a cap-driving mechanism which moves the plurality of caps toward and away from the nozzle opening surface of the ink-jet head and which presses the plurality of caps onto the nozzle opening surface, for permitting the plurality of caps to cover the nozzle opening surface.

25. The image recording apparatus according to claim 13, further comprising at least one of an ink absorber for absorbing ink and a suction device for sucking ink from the plurality of nozzles, wherein each of the plurality of caps includes an outlet for discharging ink therethrough, and wherein the internal space of each of the plurality of caps and at least one of the ink absorber and the suction device communicates with each other via the outlet of said each of the plurality of caps.

* * * * *